US005412938A

United States Patent [19]

Keller

[11] Patent Number: 5,412,938

[45] Date of Patent: May 9, 1995

[54] COMBUSTION CHAMBER OF A GAS TURBINE HAVING PREMIXING AND CATALYTIC BURNERS

[75] Inventor: Jakob Keller, Redmond, Wash.

[73] Assignee: ABB Research Ltd., Zurich, Switzerland

[21] Appl. No.: 83,898

[22] Filed: Jun. 29, 1993

[30] Foreign Application Priority Data

Jun. 29, 1992 [EP] European Pat. Off. ..... 92110969

[51] Int. Cl.[6] ..... F02C 3/34

[52] U.S. Cl. ..... 60/39.21; 60/39.52; 60/723

[58] Field of Search ..... 60/723, 737, 39.52, 60/39.21, 750; 431/328, 329

[56] References Cited

U.S. PATENT DOCUMENTS

| | | | |
|---|---|---|---|
| 2,986,882 | 6/1961 | Pavlecka | 60/39.52 |
| 3,323,304 | 6/1967 | Llobet et al. | 60/39.52 |
| 3,754,393 | 8/1973 | Handa | 431/116 |
| 3,826,083 | 7/1974 | Brandon et al. | 60/750 |
| 3,851,467 | 12/1974 | Sherman et al. | 431/116 |
| 3,927,958 | 12/1975 | Quinn | 60/39.52 |
| 3,943,705 | 3/1976 | DeCorso et al. . | |
| 3,969,892 | 7/1976 | Stettler et al. | 60/39.52 |
| 4,040,252 | 8/1977 | Mosier et al. . | |
| 4,356,698 | 11/1982 | Chamberlain | 60/737 |
| 4,433,540 | 2/1984 | Cornelius et al. | 60/723 |
| 5,081,844 | 1/1992 | Keller et al. | 60/737 |
| 5,247,993 | 1/1994 | Keller | 60/737 |

FOREIGN PATENT DOCUMENTS

| | | | |
|---|---|---|---|
| 0029619B1 | 6/1981 | European Pat. Off. . | |
| 0321809A1 | 6/1989 | European Pat. Off. . | |
| 0259331 | 10/1990 | Japan | 60/737 |

*Primary Examiner*—Timothy S. Thorpe
*Attorney, Agent, or Firm*—Burns, Doane, Swecker & Mathis

[57] ABSTRACT

A combination of pre-mixing burners and catalytic supported and preferably gas-operated burners is disposed in a combustion chamber for gas turbines, wherein the main combustion is performed by the pre-mixing burners. The pre-mixing burners and the catalytic burners are embodied to be interchangeable. The catalytic burners are provided with an exhaust gas return, wherein the exhaust gas is preferably taken from the combustion chamber. The inlet for the combustion air for the catalytic burners is embodied as a jet pump, which aspirates the exhaust gas from the combustion chamber.

3 Claims, 2 Drawing Sheets

COMBUSTION CHAMBER OF A GAS TURBINE HAVING PREMIXING AND CATALYTIC BURNERS

FIELD OF THE INVENTION

The invention relates to a combustion chamber of a gas turbine in which catalytic burners are used simultaneously with conventional burner types.

BACKGROUND OF THE INVENTION

The combination of diffusion burners and catalytic burners is known. It is used in a sort of mixed operation, wherein as a rule the combustion chamber is started up in a purely diffusion operation up to a defined partial load. Thereafter more and more catalytic burners are added. In connection with this it is intended to operate the combustion chamber fully catalytically when under full load. Catalytic burners are distinguished in that they remain operational even in a lean fuel-air mixture. On the other hand, however, they have certain disadvantages, such as a lack of a multi-fuel capability, slow controllability, problematic ignition and start-up.

Combustion chambers for gas turbines on a basis of pre-mixing burners are also known, for example from European Patent Publication EP-B1-29 619. A pre-mixing/pre-vaporization process at a large excess air coefficient operates between the injected fuel and the condenser air within a number of pipe-shaped elements, before the actual combustion process takes place downstream of a baffle. By means of this step it is possible to reduce the emission values of pollutants from the combustion process considerably.

Combustion with the largest possible excess air coefficient-provided, on the one hand, that the flame does still burn and, furthermore, that not too much CO is generated—therefore not only reduces the amount of pollutant $NO_x$, but also causes the other pollutants to be kept low, namely, as already mentioned, CO, and unburned hydrocarbons. This optimization process can be forced in the direction of even lower $NO_x$ values if the space for combustion and after-reactions within the combustion chamber is made of a larger size than would be necessary for the actual combustion. This permits a choice of a larger excess air coefficient, in the course of which initially larger amounts of CO are created which, however, can be reacted further to form $CO_2$, so that at the end the CO emissions remain small. On the other hand, only little additional NO is generated because of the large excess air. Because a plurality of pipe-shaped elements provide pre-mixing in this known combustion chamber, only a sufficient number of elements are operated with fuel during the load control so that the optimum excess air coefficient required for the respective operational phase (start-up, partial load, full load) is the result.

Other types of pre-mixing burners, wherein baffles can be omitted, are known from European Patent Publication EP-B1-0 321 809 in the form of double-cone burners.

However, all combustion chambers with pre-mixing burners present the inadequacy that, at least in the operational stages in which only a portion of the burners is operated with fuel, a close approach to the limits of flame stability is made. In fact, because of the very lean mixture and the resultant low flame temperature, the extinguishing threshold under typical gas turbine conditions will already be reached at an excess air coefficient of approximately 2.0.

OBJECT AND SUMMARY OF THE INVENTION

The invention seeks to avoid all these disadvantages. It is an object of the invention to provide an arrangement by which it is possible to operate the combustion chamber as close as possible to the lean extinguishing threshold, i.e. in that range in which practically no more $NO_x$ is created.

This object is attained in accordance with the invention by the combination of pre-mixing burners with catalytically-aided, preferably gas-operated burners, wherein the main combustion is performed by means of the pre-mixing burners.

The advantages of the invention are found, among others, in the clear support of the combustion chamber in critical phases, for example during a temporary appearance of oscillations, in the course of which the extinguishing threshold for pure pre-mixing burners might be temporarily exceeded. Because catalytic burners remain operational at very lean mixtures, control of the combustion chamber can be simplified by making it possible, during the times the gas turbine is put under load and the load is removed again, to traverse excess air coefficient areas within which as a rule it would not be possible to operate with pure pre-mixing combustion because of the lean extinguishing threshold of pre-mixing burners. Through this directed employment of the catalytic burners it is possible to circumvent their previously mentioned disadvantages.

It is particularly practical if the pre-mixing burners and the catalytic burners are embodied to be interchangeable, that is, so that the combustion chamber mountings accept either burner. With this, simple means are available to adapt the burner configuration to the respective combustion chamber operation, for instance in respect to fuel or pressure. Basically it is attempted to make it possible to operate the combustion chamber without catalytic burners in order to make the fullest use of the advantages of pre-mixing combustion. In this way the interchangeability of the different types of burners can be considered to be a sensible option for the addition of catalytic burners tailored to meet the needs of each case, in which only the number of catalytic burners as are just needed for a stable operation of the combustion chamber are employed.

In addition, it is advantageous if the catalytic burners are provided with an exhaust gas return, where the exhaust gas is preferably removed from the combustion chamber to heat the combustion air. The concept at the basis of this measure is to give the combustion mixture the minimum temperature required for operating the catalytic burners. Because of this it is possible to omit the pre-burners which up to now were customary with catalytic burners.

In this connection it is particularly useful to embody the inlet of the combustion air for the catalytic burners as a jet pump, in which case the exhaust gas from the combustion chamber is aspirated by this jet pump.

Finally, the catalytic burners are advantageously disposed in the primary zone of the combustion chamber in highly stressed areas of the wall, where they perform a kind of heat shield function. Because of this step it is possible to omit the customary cooling of the walls at the respective places, which meets the requirement for a surface which is cooled as little as possible.

An exemplary embodiment of the invention is schematically illustrated in the drawings.

DETAILED DESCRIPTION OF PREFERRED EMBODIMENTS

Only the elements essential for comprehending the invention are shown. Not shown in the installation are, for example, the association and arrangement of the combustion chamber on the rotating machines, the fuel supply, the control devices and the like. The direction of flow of the working media is indicated by arrows.

Figure 1:
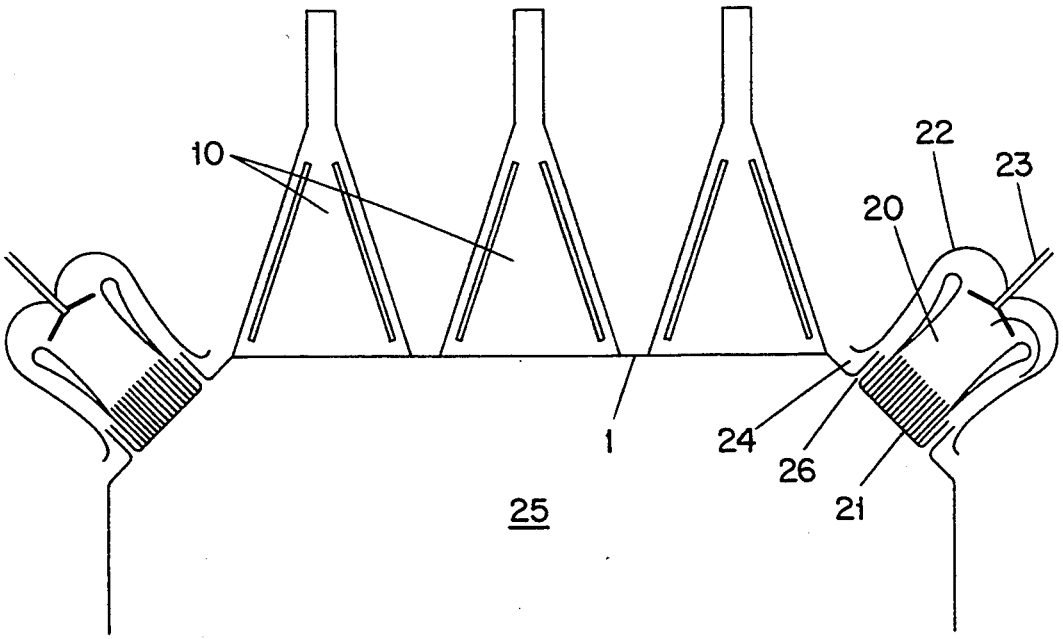
FIG. 1 is a schematic of a section of a combustion chamber.

In FIG. 1, a plurality of pre-mixing burners 10 and catalytic burners 20 are disposed in a combustion chamber wall 1 of in a dome-shaped end of a combustion chamber. The catalytic burners 20 are located at places which as a rule would have to be heavily cooled. They essentially consist of the actual catalyst 21 surrounded by a bell-shaped housing 22. A fuel supply 23 extends through the housing wall. Gas is preferably used as the fuel. The combustion air is guided into the housing interior via an annular air inlet 24. As a rule, the combustion air at the outlet of the gas turbine condenser, not shown, is at a temperature of approximately 350° C. This is insufficient for maintaining the catalytic combustion.

For this reason the air inlet 24 is embodied as a jet pump. During operation, hot combustion gas is aspirated from the combustion chamber 25 via this jet pump into the housing interior during operation. This takes place via exhaust gas nozzles 26 distributed over the circumference of the catalyst and cooled by the combustion air. The size of the jet pump and the exhaust gas nozzles are in this case such that the aspirated amount of exhaust gas is sufficiently large to assure with certainty that the critical temperature of, for example, 550° C. required for the catalyst is attained. As an example, three parts of exhaust gas at a temperature of 1,200° C. are aspirated for ten parts of combustion air at a temperature of 350° C.

Figure 2:
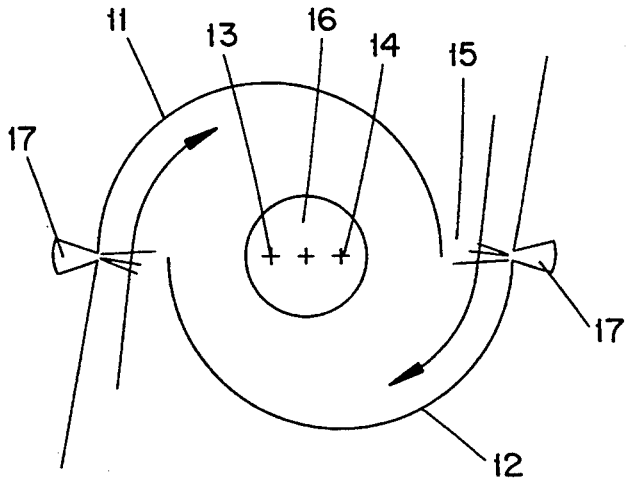
FIG. 2 is a cross-section of a pre-mixing burner.

The schematically shown pre-mixing burner 10 of FIGS. 1 and 2 is a so-called double cone burner, such as is known from European Patent Publication EP-B1-0 321 809, for example. It essentially consists of two hollow, cone-shaped partial bodies 11, 12, which are nested in each other in the direction of flow. In this case the center axes 13, 14 of the two partial bodies are offset in respect to each other. The adjoining walls of the two partial bodies form tangential slits 15 in their long extension for the combustion air, which reaches the interior of the chamber in this way. A first fuel nozzle 16 for liquid fuel is disposed there. The fuel is injected into the hollow cones at an acute angle. The conical profile of the liquid fuel created in this manner is enclosed by the tangentially inflowing air. The concentration of the fuel is continuously reduced in the axial direction because of mixing with the combustion air. The burner can also be operated with a gaseous fuel. For this purpose gas inflow openings 17, distributed in the longitudinal direction, are provided in the walls of the two partial bodies in the area of the tangential slits. During gas operation, the mixture formation with the combustion air begins already in the zone of the inlet slits 15. It is understood that mixed operation with both types of fuel is also possible in this manner.

A fuel concentration which is as homogeneous as possible is achieved at the burner outlet over the charged circular cross section. A defined cup-shaped zone of return flow is generated at the burner outlet, at the point of which the ignition takes place.

Figure 3:
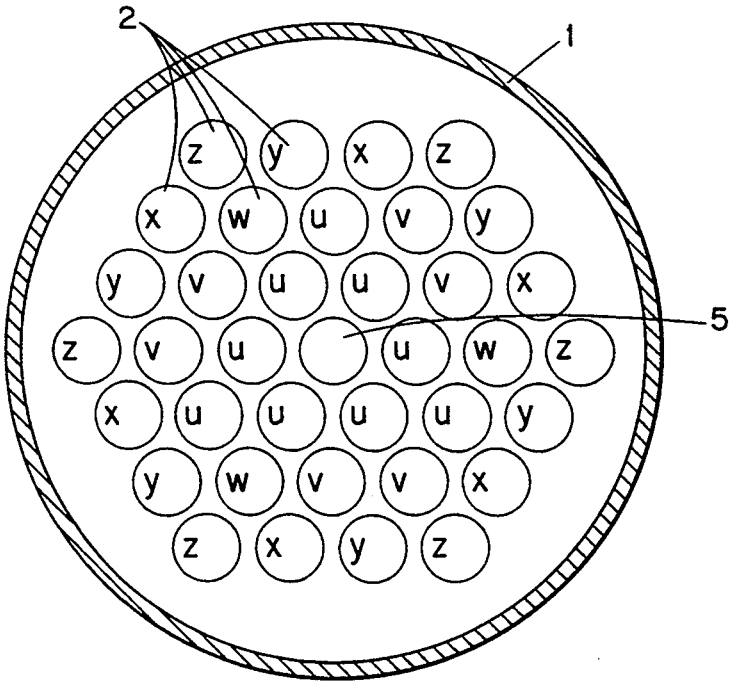
FIG. 3 is a burner arrangement in cross-section.

The function of the invention will now be described by means of the fuel control curve in FIG. 4. The burner arrangement shown in FIG. 3 is made the basis for this and the assumption is made that the burners are only added or removed in groups. In this case it has been shown to be useful first to ignite the burners located on the inside and then to bring elements located further out successively into operation. For this purpose, the burners have been divided into six groups with the following distribution: group u=9 elements, group v=6 elements, group w=3 elements, group x=6 elements, group y=6 elements, group z=6 elements. The burners of groups u, v, w, x, and y are pre-mixing burners, those of group z are catalytic burners. The groups have been indicated in this way in FIG. 3.

Not shown in the diagram is the actual start-up process of the gas turbine, which begins at approximately 20% machine rpm with the initial ignition via the centrally placed ignition burner 5 and is ended when the nominal rpm of the machine and synchronization have been achieved.

Figure 4:
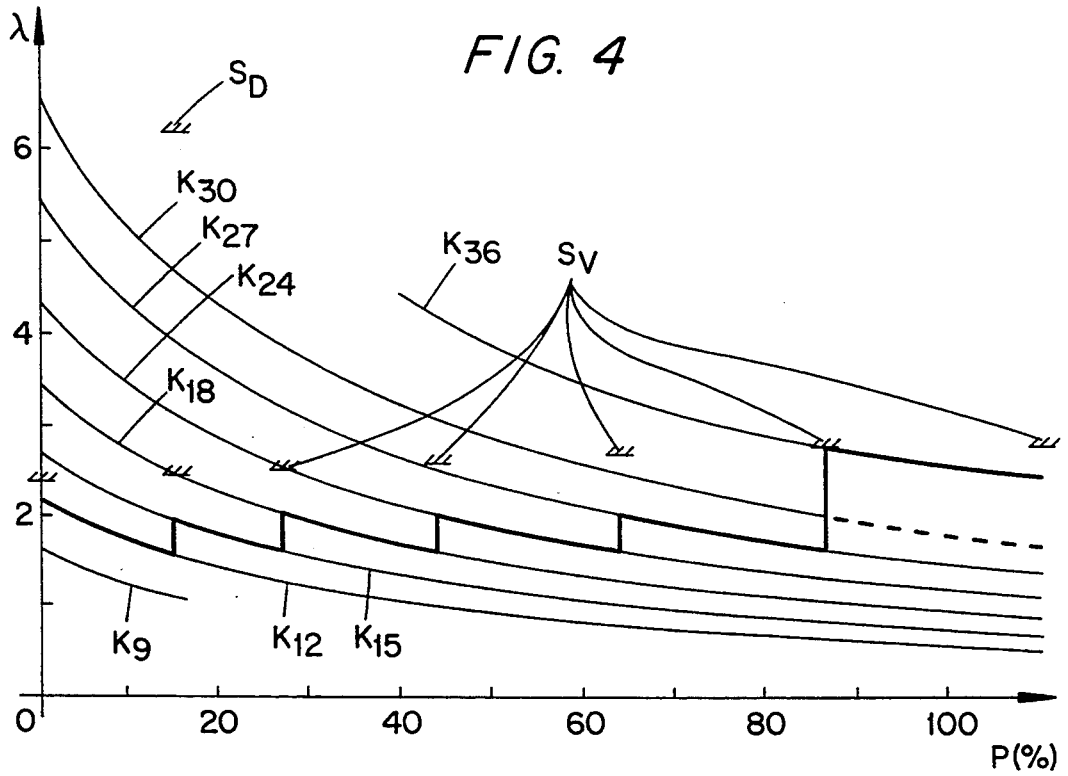
FIG. 4 is a fuel control curve showing the load on the combustion chamber during gas operation.

Thus, in the circuit diagram of FIG. 4 only the operation under load starting after idling is explained. The load P in (%) has been entered on the abscissa, and the excess air coefficient (lambda) on the ordinate. The parameters $K_{36}$, $K_{30}$, $K_{27}$, $K_{24}$, $K_{18}$, $K_{15}$, $K_{12}$, $K_9$ respectively indicate a number 36, 30, 27 . . . 9 of burners in operation. This is the optimal control curve when the combustion chamber is under load during gas operation.

The stability thresholds during purely pre-mixing combustion have been indicated by $S_v$. The stability threshold $S_D$ during the purely diffusion combustion mentioned at the outset is mentioned for comparison purposes. It can be seen here that this threshold $S_D$ lies at a very high excess air coefficient. However, with this type of operation it would not be possible to achieve the required low $NO_x$ values. By way of a standard value it can be stated that pure diffusion combustion would result in approximately 300 to 500 ppm of $NO_x$ emissions in modern gas turbines.

On the other hand, it is easily possible to fall below the required $NO_x$ threshold values with purely pre-mixing combustion. But the stability threshold is low because of the low flame temperature. The area between the ability to ignite and extinguishing is relatively narrow for the safe operation of the combustion chamber over the full load range.

As shown in the drawing, the combustion chamber is started up from idling to 15% load with twelve burners as indicated by the heavily drawn switching curve. In this case the groups u and w are operating. Because of the increase in gas supply, the excess air coefficient has become so low at 15%, that now the burner group v is added, while the group w is simultaneously shut off. Thus there are fifteen pre-mixing burners operating. In accordance with this, the further control curve during increasing load is determined in such a way that the excess air coefficient continuously moves in approximately the same range. In the example shown, at the loads P=27%, 44%, 64% and 86%, the burner groups x, y and z are respectively turned on or they are turned off for fine tuning.

In accordance with the invention, the group z with the catalytic support burners is additionally put into operation at 86% of load. This results in an operation directly on the stability threshold. It should be understood that the novel step can be used not only at full load, but also at partial loads as needed. It is basically true that it is possible with the aid of the catalytic burners to work at operational points which are not possible with purely pre-mixing combustion, because with the latter it is always necessary to maintain a set safety distance from the extinguishing threshold.

It should be added by way of explanation that with the quite common presence of stochastic noise there are already oscillations on an order of magnitude of between 10 to 20 mb. This leads to quite extensive fluctuations of the excess air coefficient, which has the values shown in FIG. 4 only as average values, but in actuality fluctuates in a range around these average values. This fact leads, on the one hand and depending on the amplitude of the oscillation, to clearly increased $NO_x$ values, and on the other hand to a dangerous approach to the extinguishing threshold. The difference of 10 to 15 mb in the pressure fluctuation already leads to an additional 5 to 8 ppm $NO_x$.

Thus, the novel operation on the extinguishing threshold results in the fact that it is safely possible to fall below the $NO_x$ values of 20 ppm which can be achieved today.

What is claimed is:

1. A combustion chamber for gas turbines, comprising:

a plurality of pre-mixing burners for performing a main combustion; and a plurality of catalytically supported gas-operated burners to support the main combustion, each catalytic burner having at least one exhaust gas nozzle to duct exhaust gas directly from the combustion chamber into the catalytic burner and a combustion air inlet formed as a jet pump for aspirating exhaust gas from the combustion chamber through the exhaust gas nozzle into the catalytic burner along with inflowing combustion air.

2. A combustion chamber in accordance with claim 1, further comprising a plurality of mounting means for individually mounting the pre-mixing burners and the catalytic burners, the pre-mixing burner and the catalytic burners being interchangeably mountable in each of the mounting means.

3. A combustion chamber for a turbine engine, comprising:

a plurality of pre-mixing burners for performing a main combustion;

at least one catalytic burner for supporting combustion, each catalytic burner having at least one exhaust gas nozzle to duct exhaust gas directly from the combustion chamber and a combustion air inlet formed as a jet pump for aspirating exhaust gas from the combustion chamber through the exhaust gas nozzle into the catalytic burner mixed with combustion air, the mixed exhaust gas and combustion air being at a temperature sufficient for catalytic combustion; and means for operating the pre-mixing burners as at least one group and means for operating the catalytic burner as a group.

* * * * *